US008425704B2

(12) United States Patent
Currano et al.

(10) Patent No.: US 8,425,704 B2
(45) Date of Patent: Apr. 23, 2013

(54) SILICON-BASED EXPLOSIVE DEVICES AND METHODS OF MANUFACTURE

(75) Inventors: Luke J. Currano, Columbia, MD (US); Ronald G. Polcawich, Derwood, MD (US); Wayne Churaman, Arnold, MD (US); Mark Gelak, Columbia, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 324 days.

(21) Appl. No.: 12/535,141

(22) Filed: Aug. 4, 2009

(65) Prior Publication Data

US 2012/0174808 A1 Jul. 12, 2012

(51) Int. Cl.

| | |
|---|---|
| ***H01L 21/76*** | (2006.01) |
| ***C06B 45/00*** | (2006.01) |
| ***C06B 45/12*** | (2006.01) |
| ***C06B 33/00*** | (2006.01) |
| ***D03D 23/00*** | (2006.01) |
| ***D03D 43/00*** | (2006.01) |

(52) U.S. Cl.

USPC ..... 149/109.6; 438/409; 149/2; 149/14; 149/37; 149/108.6

(58) Field of Classification Search ..... 438/409; 149/2, 14, 37, 108.6

See application file for complete search history.

(56) References Cited

U.S. PATENT DOCUMENTS

| | | | | |
|---|---|---|---|---|
| 5,309,841 | A * | 5/1994 | Hartman et al. | 102/202.4 |
| 6,984,274 | B2 * | 1/2006 | Hofmann et al. | 149/2 |
| 2005/0072502 | A1 * | 4/2005 | Hofmann et al. | 149/37 |

* cited by examiner

*Primary Examiner* — James McDonough
(74) *Attorney, Agent, or Firm* — Alan I. Kalb

(57) ABSTRACT

Silicon-based explosive devices and methods of manufacture are provided. In this regard, a representative method involves: providing a doped silicon substrate; depositing undoped silicon on a first side of the substrate; and infusing an oxidizer into an area bounded at least in part by the undoped silicon; wherein the undoped silicon limits an exothermic reaction of the doped silicon to the bounded area. Another representative method involves: providing a doped silicon substrate; depositing a masking layer of low-pressure chemical vapor deposited (LPCVD) Silicon nitride to the first side of the substrate; patterning the nitride mask and etching the porous silicon, and infusing oxidizer into an area bounded by the LPCVD nitride; wherein the silicon nitride limits an exothermic reaction of the doped silicon to the bounded area.

17 Claims, 3 Drawing Sheets

SILICON-BASED EXPLOSIVE DEVICES AND METHODS OF MANUFACTURE

GOVERNMENT INTEREST

The invention described herein may be manufactured, used, and licensed by or for the United States Government.

BACKGROUND OF THE INVENTION

1. Field of the Invention

This invention pertains to explosives and more specifically to silicon-based explosives.

2. Description of the Related Art

The combination of porous silicon and an oxidizer has been known to have energetic properties for years. Both concentrated nitric acid and liquid oxygen, when added to porous silicon immediately after etching, have been found to cause an explosive reaction. Notably, these experiments involve liquid reagents and spontaneous reactions. However, use of liquid reagents and resulting spontaneous reactions typically are not practical implementations for explosives.

The process for making explosive silicon with a solid oxidizer appears to have originated at the University of California at San Diego, where it was discovered during work with porous silicon for luminescent emitters. In particular, it was discovered that when a solution of Gadolinium Nitrate salt dissolved in ethanol was added to a freshly etched sample of porous silicon, and the ethanol was evaporated away to leave a solid salt, an energetic exothermic reaction of the material could be induced by scratching it with a scribe. An acoustic report and a flame were emitted from the sample.

SUMMARY OF THE INVENTION

The present invention provides a plurality of embodiments of Silicon-based explosive devices and methods of manufacture. In one embodiment of the invention such a method comprises: providing a doped silicon substrate; depositing a masking material on a first side of the substrate; forming pores in the first side of the substrate in an area defined by the masking material; infusing an oxidizer into at least some of the pores; and coupling an initiator to the area, the initiator being operative to initiate an exothermic reaction of the doped silicon of the area defined.

In another embodiment of a method for manufacturing a silicon-based explosive device comprises: providing a doped silicon substrate; depositing undoped silicon on a first side of the substrate; forming pores in the first side of the substrate; and infusing an oxidizer into an area bounded at least in part by the undoped silicon; wherein the undoped silicon limits an exothermic reaction of the doped silicon to the bounded area.

While another embodiment of a silicon-based explosive device comprises a doped silicon substrate having a first side and an opposing second side. A region of masking material is located on a first side of the substrate, with the region of masking material defining an area of the substrate having pores. An oxidizer is located in at least some of the pores. An initiator is monolithically integrated with the substrate, with the initiator being operative to initiate an exothermic reaction of the silicon located in the area defined by the masking material.

Finally, in another embodiment of the method for manufacturing a silicon-based explosive device, there is provided a doped silicon substrate having electronic, mechanical, optical, fluidic or other devices already residing on the substrate. It is important to protect these devices with a region of masking material. After application of the masking material, pores are formed in an adjacent area. The masking material is then removed from the protected devices to restore them to normal function, after which an oxidizer is infused into at least some of the pores.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
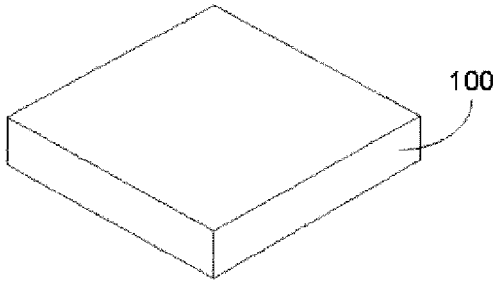
FIG. 1 is a schematic illustration of an intermediate result of a manufacturing process of an embodiment of an explosive device.

Silicon-based explosive devices and methods of manufacture are provided. In this regard, an embodiment of such a device incorporates a porous silicon substrate with an initiation mechanism. In some embodiments, the initiation mechanism is patterned directly adjacent to or on top of the porous region and, thus, is monolithically integrated with the device.

As will be described in detail later, immediate infusion of an oxidizer into the pores of the silicon is not required as appears to be the case with prior art techniques. On the contrary, it appears that when produced by a method such as described herein, porous silicon samples can be left indefinitely before the oxidizer is introduced without altering the reactivity. This characteristic can be desirable for various reasons, such as safety in handling, post-processing, packaging, and assembly. That is, without the oxidizer, the porous silicon can be non-energetic during these tasks. Notably, the silicon sample can then be activated by adding the oxidizer before the system containing the explosive is to be deployed.

It should also be noted that patterning of porous silicon is very difficult. Specifically, the most common conventional technique uses an HF/ethanol electrochemical etchant for the porous silicon etch process. In this regard, HF aggressively attacks many common mask layers, including photoresist and $SiO_2$. Metal masking techniques were generally found not to work because the HF attacks the adhesion layer required for many metals and causes the metal to delaminate from the substrate. Even metals that generally survive an HF etch have been found to delaminate once electrical current is applied.

In order to accommodate these considerations, several different masking processes have been developed that survive the electrochemical HF etch. It was known in the art that low-pressure chemical vapor (LPCVD) deposited silicon nitride is removed at a relatively slow rate. Patterning with silicon nitride is accomplished by depositing a layer of LPCVD silicon nitride on the wafer, spinning photoresist on top of the silicon nitride, patterning the photoresist using standard lithographic techniques, and transferring the pattern to the silicon nitride using reactive ion etching or other standard silicon nitride etch processes. LPCVD silicon nitride has been used as a masking material in our work. Typically the thickness of LPCVD nitride layers is limited to 3000 angstroms or less because the high stress in the film causes cracking in thicker layers. Notably, we have also found that low-stress non-stoichiometric silicon nitride may be used for thicker masking layers and therefore deeper porous etches, as long as it is deposited by a high temperature process such as LPCVD. The low stress silicon nitride also allows for arbitrarily small patterned shapes and sharp corners without cracking.

One embodiment uses a spin-coatable dodecene material called Protek A2-22 manufactured by Brewer Science Inc. and designed for HF etch resistance (although not electrochemical etch resistance) also survives the etch process. Patterning of separate porous regions with Protek is accomplished by spinning photoresist on top of the Protek, patterning the photoresist via standard lithographic techniques, and transferring the pattern to the Protek via reactive ion etching in oxygen plasma. In one embodiment, the Protek is used to protect devices already present on the substrate before the electrochemical etch, and the low-stress silicon nitride is used to pattern the porous regions on the substrate. In this way, the energetic porous silicon can be monolithically integrated with silicon based electronic, optical, mechanical, thermal, or fluidic devices.

Finally, methods such as sputtered, undoped silicon to pattern the energetic regions are successful. Pores do form in the sputtered silicon during the etch phase, but the difference in electrical resistivity between the sputtered material and the bulk substrate material causes a large difference in pore size, with the pores much larger in the sputtered material. The larger pore sizes and the small thickness (1 micrometer is typical) reduce the surface area of these areas substantially. The result is that areas covered by sputtered silicon do not react with the oxidizer in the exothermic reaction, allowing separation of several explosive areas on a single substrate.

Any of the above mentioned patterning techniques allow for the adjacent placement of multiple active porous regions. If the spacing between these active regions is large enough compared to the size of the active regions, each may be independently ignited without affecting the others. We have demonstrated spacing as low as 2 millimeter with active 2 millimeter diameter circular areas without sympathetic ignition.

As mentioned above, metals generally do not survive the porous silicon etch process. Likewise, the porous silicon surface is seemingly incompatible with post-etch lithographic processing, at least for the purposes of making explosive Si. That is, after patterning and stripping of photoresist and then introducing the oxidizer, such a sample can no longer be induced to explode.

In some embodiments, an electronic initiator, e.g., a bridgewire, is formed by etching a desired pattern completely through a dummy wafer. The dummy wafer is then attached to the already-etched porous silicon substrate, and a metal or stack of metals is deposited through the orifice in the dummy wafer. This technique is called shadow-masking. The initiator can then be wirebonded or soldered to an electrical lead at each end, and the oxidizer solution can be applied after this step. The incorporation of the initiator directly on the surface of the porous silicon device ensures close thermal, physical, and electrical contact between the initiator and the explosive so that repeatable and predictable performance can be realized. The wirebonding or soldering is conducted before the application of the oxidizer to avoid unnecessary heating of an active energetic mixture and to ensure that the electrical connections are not contaminated by the oxidizer.

In other embodiments, an electronic initiator, e.g., a bridgewire is formed by lithographic patterning on the surface of an already-etched porous silicon substrate. This is accomplished through first closing off the pores at the surface of the wafer, patterning photoresist on top of the porous substrate through conventional methods, depositing a metal or stack of metals through the photoresist openings onto the porous silicon substrate, removing the photoresist using conventional methods, and then removing the material use to close off the pores. In yet another embodiment, the material used to close off the pores is sputtered Cr, and the stack of metals for the bridgewire is titanium (for adhesion to the substrate), platinum (as a diffusion barrier for the gold) and gold as the primary conductor.

A method for manufacturing an embodiment of an explosive device will now be described with reference to FIGS. 1-7. As shown in FIG. 1, a substrate 100 (e.g., a blank, double side polished, silicon wafer) is provided. In this embodiment, the wafer is doped to 1-10 Ω-cm. However, various other doping levels could be used. It should be noted that the doping level affects the pore size and nature of the energetic reaction. Notably, the wafer can be either N-type or P-type.

Figure 2:
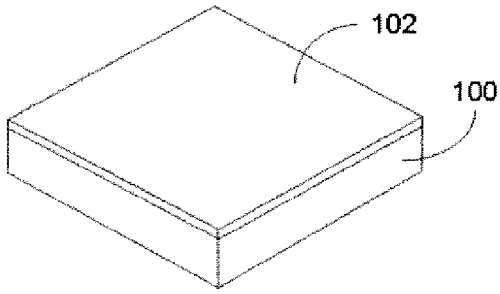
FIG. 2 is a schematic illustration of an intermediate result, subsequent to that depicted in FIG. 1, of a manufacturing process of an embodiment of an explosive device.

In FIG. 2, the wafer is coated on one side with a metal electrode 102. The metal electrode can be formed by various processes. For instance, the metal electrode can be sputtered or evaporated onto the wafer. Various metals of various thicknesses can be used. By way of example, an 850 Å thick platinum electrode with a 200 Å thick titanium adhesion layer between the platinum and the silicon can be used. Notably, such a platinum layer can be annealed, such as for 60 seconds at 700° C., to ensure good electrical contact between the silicon wafer and the platinum layer.

In other embodiments, an electrode formed as an integral part of the device can be omitted. In such an embodiment, electrical connectivity to the underside of the device can be accomplished in other manners. For instance, the device can be clamped to a sheet of metal foil.

Figure 3:
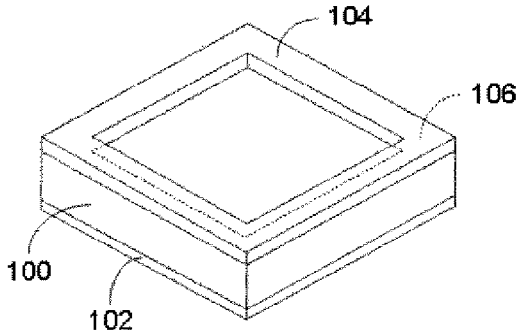
FIG. 3 is a schematic illustration of an intermediate result, subsequent to that depicted in FIG. 2, of a manufacturing process of an embodiment of an explosive device.

As shown in FIG. 3, the side of the wafer opposite the metal electrode 102 is patterned with masking material 104, for example silicon nitride, undoped polysilicon or Protek A2-22, to define areas that should not be allowed to react. In this example, area 106 (which is located under material 104) is designated not to react.

Two exemplary techniques for defining area 106 will now be described in greater detail. In particular, one such technique includes photolithographically defining a reverse image of the area. Polysilicon or silicon nitride is then applied on top of the photoresist, such as by sputtering or evaporating, for example. The photoresist then can be dissolved, such as in stripper or acetone. The polysilicon/silicon nitride will adhere to those portions not covered with photoresist.

The other exemplary technique involves depositing polysilicon/silicon nitride over the entire wafer such as via sputtering, evaporation, low-pressure chemical vapor deposition (LPCVD), or other techniques. The wafer is then photolithographically patterned to form a positive image of the area. The photoresist is then used as a mask when etching away the underlying polysilicon/silicon nitride. The photoresist can then be removed by photoresist stripper, acetone, or an oxygen plasma ash, for example.

Figure 4:
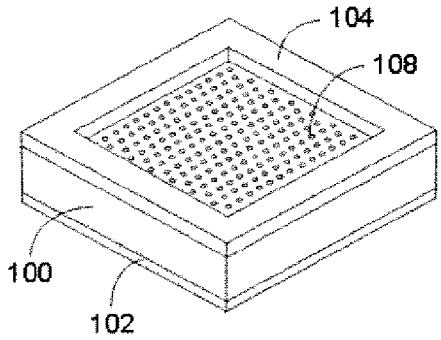
FIG. 4 is a schematic illustration of an intermediate result, subsequent to that depicted in FIG. 3, of a manufacturing process of an embodiment of an explosive device.

As shown in FIG. 4, a porous surface layer 108 is created in the front side of the wafer. This can be accomplished, for example, by immersing the wafer in a 1:1 or 2:1 solution of ethanol and 49% HF and driving a current through the wafer by applying a bias voltage between the back of the wafer and an electrode suspended in the etch solution. Notably, the size, number and spacing of the pores is exaggerated for clarity in the figures. In reality, the pores are usually a few nanometers to a few tens of nanometers in diameter.

The backside of the wafer, i.e., the side with the metal electrode 102, should be protected during the etch phase. By way of example, a Teflon etch cell can be used that only exposes the front side of the wafer to the etch solution. By way of further example, the backside and edges of the wafer could be coated, such as with wax or tape.

If the wafer is N-type, white light illumination is applied to the front surface of the wafer in order to generate electron-hole pairs. When using P-type wafers, however, illumination is not necessary.

It has been found that a porous layer about 25 μm deep with pores a few nanometers in diameter can be produced using 20 $mA/cm^2$ for 30 minutes in 1:1 HF/ethanol solution. Notably, if polysilicon is used as a patterning material, the polysilicon surface becomes porous as well, but the pores are much larger because the resistivity is higher in these areas.

It should also be noted that the polysilicon-covered area can not be induced to react with the oxidizer when processing is completed. The reason for this is thought to be either that the pores are too large, or that the layer is too thin to afford the large amount of surface area necessary for a reaction. Regardless of the underlying reason, such a technique affords an effective method for separating adjacent areas of explosives on the same silicon chip. This can allow multiple sequential or targeted detonations. If silicon nitride is used, etching does not occur in the covered regions, so they are likewise inert.

After being removed from the etch solution, the sample is rinsed such as in ethanol or pentane. The sample is then dried such as by being placed under a stream of nitrogen. Then, the sample is aligned and affixed to the back of a shadowmask preferably made from a silicon wafer (not shown). The shadowmask has the initiator geometry etched completely through from one side to the other such as by using deep reactive ion etching (DRIE).

A promising technique for aligning the sample and the shadowmask involves the use of mechanical posts on the sample (not shown). The posts can be made by etching most of the wafer surface 20-100 μm and masking the posts from the etch phase. The posts then can be matched to pits in the shadowmask. By way of example, the pits can be formed completely through the shadowmask, etched in the same step as the initiator features.

Figure 5:
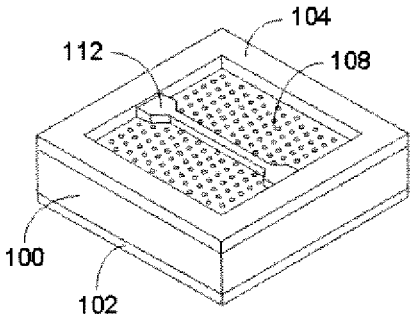
FIG. 5 is a schematic illustration of an intermediate result, subsequent to that depicted in FIG. 4, of a manufacturing process of an embodiment of an explosive device.

If mechanical alignment is used, it is preferred that the posts be made after the backside electrode deposition (FIG. 2) but before the polysilicon or silicon nitride masking step (FIG. 3). Once the sample and the shadowmask are aligned, contact and alignment should be maintained while deposition is completed such as by applying tape. Notably, sputtering is a preferred deposition technique for forming an initiator, since it typically yields better adhesion and better coverage of the porous surface. In some embodiments, a metal stack of Ti/Pt/Au, with thicknesses of 200 Å/1000 Å/3800 Å can be used to form an initiator 112, such as shown in FIG. 5.

In this embodiment, the initiator is a thin-film bridgewire, which is essentially a wire across the porous region with a narrowed portion in the middle. When a potential is applied across the bridgewire, current flows through the wire and heats up the center portion via Joule heating. The Joule heating generates enough energy to begin an exothermic reaction between the silicon and an oxidizer located in the surface pores (described later). Such a reaction is self-sustaining once it has begun.

After depositing the initiator, the shadowmask and sample are separated, and the sample is cleaved into an individual die. Notably, cleaving can be facilitated by cleave lines (not shown) that can be patterned and etched into the front of the substrate (such as by DRIE) as an optional step in the processing.

A second method for manufacturing the bridgewire will now be described. In this embodiment the patterning and etching of the porous material is identical to the above method, but the thin-film initiator is photolithographically patterned adjacent to the porous layer. This allows for increased design freedom and tighter geometrical constraints on the bridgewire and better alignment of the bridgewire to the patterned porous silicon regions. In at least one embodiment a protective layer is used over the pores. The pores are protected by purposely closing off the pore openings with a thin layer of sputtered material. This protective layer serves two purposes—to prevent the photoresist from clogging or contaminating the pores, and to prevent chemical etching of the porous silicon matrix in standard photoresist developers and strippers. For example 500A of chromium can be deposited by sputtering over the entire first side of the wafer. Photoresist is deposited and patterned using standard procedures to define the shape of the initiator. The sputtered protection layer is removed from the regions that have been photolithographically patterned via wet or dry etching. The initiator wire is then deposited on the nitride layer adjacent to the porous silicon. Alternatively, the protection layer and silicon nitride may both be removed in the patterned regions and the initiator deposited on the (non-porous) silicon underneath the silicon nitride. The initiator wire is positioned directly adjacent to the porous region for optimal thermal transport from the heated wire to the reactive material. The photoresist is removed and the final shape of the bridgewire is formed via liftoff in acetone. The protective layer is removed via a selective etch process. If the protective material is chromium, a commercial liquid chromium etchant such as CR-9 may be used.

Figure 6:
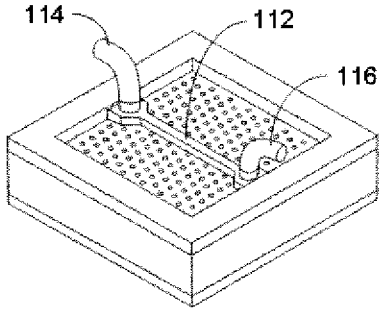
FIG. 6 is a schematic illustration of an intermediate result, subsequent to that depicted in FIG. 5, of a manufacturing process of an embodiment of an explosive device.

In FIG. 6, external electrical connections 114 and 116 are attached to the bridgewire such as by wirebonding or soldering. The external electrical connections 114 and 116 are used to provide electrical connections to other components, such as a current source for heating the initiator. The configuration shown in FIG. 6 is well suited for incorporation into a package due primarily to the fact that the device is inert in this configuration.

Figure 7:
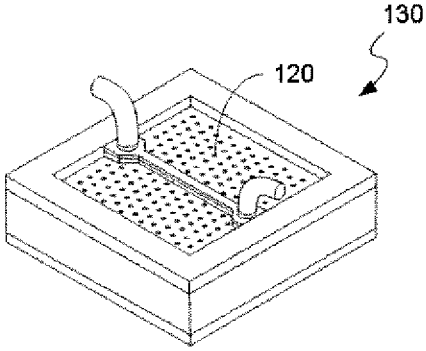
FIG. 7 is a schematic illustration of an embodiment of an explosive device.

In FIG. 7, however, an oxidizer 120 is infused into the porous layer of the silicon such that the device 130 is no longer inert. In this regard, an oxidizer solution such as Sodium Perchlorate ($NaClO_4$) dissolved in a solvent such as alcohol can be used. However, in other embodiments, other salt solutions such as Calcium Perchlorate, Gadolinium Nitrate, Lithium Perchlorate, Potassium Nitrate, Ammonium Nitrate or even sulfur can be used, with some of these other oxidizers potentially yielding better results.

Regardless of the particular oxidizer solution used, the solution is applied such as by using an eyedropper, a syringe, an inkjet printhead, or other means. The solution is then allowed to dry and the solvent to evaporate, e.g., for at least several minutes. The drying is enhanced by placing the sample in a low-humidity or vacuum environment or by air drying at elevated temperatures. At this point, the device is active and can be detonated by applying sufficient electrical current to the initiator 112.

The benefit of leaving the oxidizer application to the end of processing is that the device is not active and presents no handling hazards during the previous processing steps. In addition, in some application processes such as an eyedropper, the oxidizer solution tends to crystallize on all available surfaces, including the initiator. This tends to make it difficult to establish electrical contact to the initiator via wirebonding or other techniques if the oxidizer solution is applied prior to this step.

For low voltage operation, one embodiment uses a metallization stack for the bridgewire of Ti/Pt/Au, with thicknesses of 200 Å/1000 Å/3800 Å. The titanium serves as an adhesion layer, and the platinum provides a migration barrier between the gold and the silicon. This configuration reduces a reaction between the gold and the silicon layer when the bridgewire heats. Notably, such a reaction can cause the bridgewire to fail before the explosive reaction is triggered if the platinum layer is not present. It should also be noted that the ends of the bridgewire should ideally extend beyond the porous region onto the unetched silicon or nitride masking layer because the wirebonding process can cause the porous layer to delaminate from the substrate if wirebonding is attempted over the porous region.

Figure 8:
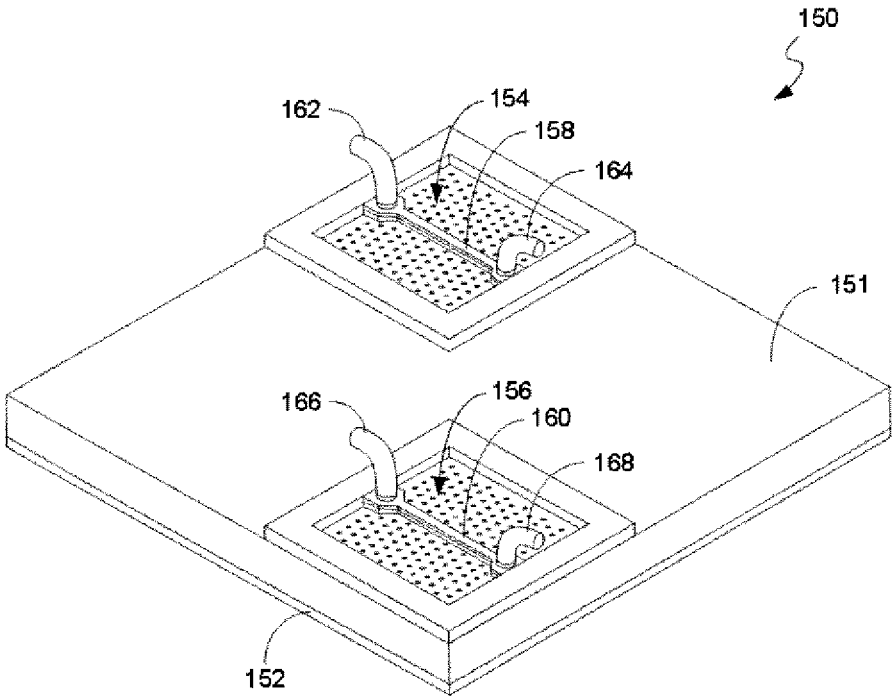
FIG. 8 is a schematic illustration of another embodiment of an explosive device.

In some embodiments, adjacent energetic areas can be provided on the same silicon chip using the patterning techniques described above. Thus, a single device can offer multiple sequential or targeted energetic reactions. In this regard, FIG. 8 depicts an embodiment of such a device. Specifically, device 150 of FIG. 8 includes a wafer 151, with a metal electrode 152 located on a side thereof. On the side opposing the metal electrode, energetic areas are designated. Specifically, device 150 incorporates a first energetic area 154 and a second energetic area 156, as well as corresponding initiators (158, 160) and pin-outs (162, 164 and 166, 168).

Areas 154 and 156 are formed as oxidizer-infused porous regions such as by the process steps described above. Notably, in this embodiment, the areas are identically sized, spaced from each other, and located at opposing corners of the substrate. However, in other embodiments, various other numbers, sizes and arrangements of explosive areas can be used.

It should be emphasized that many variations and modifications may be made to the above-described embodiments. By way of example, although described herein with respect to bridgewires, various other forms of initiators, such as heated bridgewires, exploding bridgewire/foil initiators, percussion hammers, friction initiators, optical initiators and slapper detonators can be used. In some embodiments, the initiator can comprise two conductive structures with a gap located there between. Responsive to a voltage being applied across the two conductive structures, a spark arcs across the gap to initiate an exothermic reaction. All such modifications and variations are intended to be included herein within the scope of this disclosure and protected by the following claims.

We claim:

1. A method for manufacturing a silicon-based explosive device comprising:

providing a silicon substrate;

depositing a masking material on a first side of the substrate;

forming pores in the first side of the substrate in an area defined by the masking material forming an initiator on the substrate and coupling it to the area, the initiator being operative to initiate an exothermic reaction of the porous silicon of the area defined, and filling the pores at least partially with an oxidizer, the oxidizer being operative to sustain an exothermic reaction once it is initiated.

2. The method of claim 1, wherein the pores are formed by an electrochemical etch process.

3. The method of claim 1, wherein the initiator is coupled to the area before forming the pores.

4. The method of claim 3, further comprising:

depositing a masking material over the initiator such that the initiator is protected during the forming step, depositing and patterning a photoresist layer on to of the masking material, and etching the masking material using a gas or liquid etch such that the initiator is protected during the forming step.

5. The method of claim 4, wherein the masking material is a spin-coatable HF-resistant Material.

6. The method of claim 1, wherein the initiator is coupled to the area after forming the pores, and forming a shadowmask defining a desired shape of the initiator;

engaging the substrate with the shadowmask, depositing the initiator through the shadowmask using means including but not limited to sputtering, evaporation, chemical or electrochemical deposition.

7. The method of claim 1, further comprising:

Infusing an oxidizer into the pores, forming a protective layer over the pores by closing off the pores at the surface, the protecting layer being operative to prevent clogging of the pores with photoresist or other contaminants during the forming of the initiator;

depositing photoresist on top of the protective layer;

patterning the photoresist via standard lithographic techniques;

removing the protective layer in the photoresist openings;

depositing an initiator material through the photoresist openings;

patterning the initiator material into the desired shape by dissolving the photoresist; and removing the protective layer from the remaining area of the substrate.

8. The method of claim 7, wherein the infusing is performed after the coupling of the initiator.

9. The method of claim 7, wherein infusing comprises:

applying an oxidizer solution to at least partially till the pores; and allowing the oxidizer solution to dry.

10. The method of claim 1, wherein the masking material is undoped silicon.

11. The method of claim 1, where the masking material is silicon nitride.

12. The method of claim 1, wherein coupling of the initiator comprises:

forming a shadowmask defining a desired shape of the initiator;

engaging the substrate with the shadowmask; and, depositing the initiator through the shadowmask.

13. The method of claim 1, wherein coupling of the initiator comprises:

forming a protective layer on the substrate by closing off the pores in the first side of the substrate at the surface;

depositing photoresist on top of the protective layer;

patterning the photoresist via standard lithographic techniques;

removing the protective layer in the photoresist openings;

depositing a initiator material through the photoresist openings;

patterning the initiator material into the desired shape by dissolving the photoresist; and removing the protective layer from the remaining area of the substrate.

14. The method of claim 13, wherein the protective layer is deposited by sputtering.

15. The method of claim 13, wherein the protective layer is chromium.

16. The method of claim 1, wherein:

the area defined by the masking material is a first area; and the method further comprises defining a second area of the substrate such that an exothermic reaction of the silicon of the second area can occur separate and apart from that of the first area.

17. The method of claim 1, wherein the masking material prevents the exothermic reaction of the silicon substrate located therebeneath.

* * * * *